US008070498B2

(12) United States Patent
Shen

(10) Patent No.: US 8,070,498 B2
(45) Date of Patent: Dec. 6, 2011

(54) CONTACT AND ELECTRICAL CONNECTOR HAVING SUCH CONTACT

(75) Inventor: Leif Shen, Chingli Tayuan (TW)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 12/998,193

(22) PCT Filed: Sep. 21, 2009

(86) PCT No.: PCT/IB2009/055095

§ 371 (c)(1),
(2), (4) Date: Mar. 25, 2011

(87) PCT Pub. No.: WO2010/052685

PCT Pub. Date: May 14, 2010

(65) Prior Publication Data

US 2011/0177718 A1 Jul. 21, 2011

(30) Foreign Application Priority Data

Sep. 28, 2008 (CN) ..... 2008 2 0210720 U

(51) Int. Cl.
*H01R 12/00* (2006.01)

(52) U.S. Cl. ..... 439/66; 439/862

(58) Field of Classification Search ..... 439/65, 439/66, 862, 625

See application file for complete search history.

(56) References Cited

U.S. PATENT DOCUMENTS

| | | | | | |
|---|---|---|---|---|---|
| 5,271,741 | A | * | 12/1993 | Saito et al. | 439/843 |
| 5,480,320 | A | * | 1/1996 | Saimoto | 439/852 |
| 5,575,696 | A | * | 11/1996 | Endo et al. | 439/852 |
| 5,735,717 | A | * | 4/1998 | Nabeshima | 439/851 |
| 5,980,336 | A | * | 11/1999 | Hall et al. | 439/843 |
| 6,152,788 | A | * | 11/2000 | Hata et al. | 439/852 |
| 7,131,875 | B2 | | 11/2006 | Kodaira et al. | 439/862 |
| 2002/0086591 | A1 | | 7/2002 | Orihara | 439/862 |

FOREIGN PATENT DOCUMENTS

| | | |
|---|---|---|
| JP | 7-45314 | 2/1995 |
| JP | 2003-45521 | 2/2003 |

* cited by examiner

*Primary Examiner* — Tulsidas C Patel
*Assistant Examiner* — Travis Chambers
(74) *Attorney, Agent, or Firm* — Harrington & Smith

(57) ABSTRACT

The present invention relates to a contact and an electrical connector having such contacts. The contact is formed as a single piece of elastic metal sheet and includes a base frame and a spring arm restrained by the base frame in a preload state. The base frame includes two side walls each having a stopper projection formed in a plane within which a corresponding side wall is disposed. The spring arm is formed with opposite projections which are pressed down and constrained in position by the stopper projections respectively. The contact can be manufactured in a simple way and presents a high reliability.

11 Claims, 3 Drawing Sheets

CONTACT AND ELECTRICAL CONNECTOR HAVING SUCH CONTACT

TECHNICAL FIELD

The present invention relates to a contact for forming electrical connection and an electrical connector having one or more such contacts.

BACKGROUND ART

In the application of establishing electrical connection using a contact, several types of contacts are known. By way of example, U.S. Pat. No. 7,131,875 discloses a contact for an electrical connector, which contact comprising a soldering part to be soldered to a circuit board or an electrical device, a pair of side wall parts rising from a portion of the soldering part, and a spring arm extending from another portion of the soldering part and then bending towards the side wall parts. A bent part of the spring arm is continued by a contact protruding part configured to electrically contact with a corresponding contact of a matching electrical device. The bent part is elastically pushed down and held in a preload state by a pair of preload application parts which are bent inwardly from the side wall parts respectively. The preload application parts of this contact are formed by inwardly bending corresponding parts of the side wall parts, which results in a complex manufacturing process. Further, the whole soldering part extends horizontally, and the spring arm is formed as extending from the soldering part upwardly and then bending back horizontally. In this way, the vertical extending part and the horizontal bending part of the spring arm in combination with the soldering part form a frame having a generally rectangular shape. Such a frame is not an ideal structure because, when the contact protruding part is pushed down by the matching electrical device, the soldering part is subjected to a torque which tends to lift a front end of the soldering part up from the electrical device on which the contact is welded. Thus, after a certain time of using, the welding condition of the contact may be deteriorated.

SUMMARY OF INVENTION

The present invention is aimed at overcoming the above defect existed in the prior art by providing a contact which has a simple structure and being easy to manufacture. In addition, the contact can provide reliable electrical connection as well as firm mechanical attachment.

To this end, the present invention in one aspect provides a contact for forming electrical connection between a first electrical device and a second electrical device, the contact being formed as a single piece of a sheet of an elastic metal material and comprising:

a base frame having a flat bottom wall and two side walls extending perpendicularly from opposite lateral edges of the bottom wall respectively, the bottom wall being configured to be fixed to the first electrical device; and a spring arm formed integrally with the base frame and constrained by the base frame in a preload state, the spring arm having a forward extending portion extending forwardly from a front end of the bottom wall, a bent portion extending upwardly from the forward extending portion and then bending backwardly, a backward extending portion extending backwardly from the bent portion into the interior of the base frame, and a contact portion protruding upwardly from the backward extending portion and being configured to be pushed down by the second electrical device. A stopper projection is formed at an upper front portion of each side wall, the stopper projection being located in a same plane within which the side wall is disposed; and a back end of the backward extending portion is formed with projections extending out from its opposite lateral edges. The projections engage with the stoppers to limit a displacement range of the contact portion. Additionally, the projections are pushed down and constrained in position by the stopper projections respectively.

In one embodiment, each side wall is formed with a notch at the middle portion of the front edge of the side wall, the stopper projection being formed between the under cut and the front edge of the side wall.

In another embodiment, opposite cutouts are formed between a back end of the forward extending portion and the front end of the bottom wall.

In an alternative, the forward extending portion has a wave-like shape, and the bent portion has an arch shape.

In yet another embodiment, the forward extending portion and the bent portion each have a width that is substantially equal to the width of the base frame, the contact portion has a width that is smaller than the width of the base frame, and the backward extending portion has a width that is narrowed from its front end to its back end.

In still another embodiment, the vertical central axis of the contact portion lies in front of the vertical central axis of the base frame in a longitudinal direction.

In a further embodiment, the contact portion comprises an upward extending section and a contacting section, the upward extending section extending upwardly from the back end of the backward extending portion, and the contacting section having an upwardly convexed arch shape and a front end connected with an upper end of the upward extending section.

In another embodiment, the contact portion further comprises a downward extending section, the downward extending section extending downwardly from a back end of the contacting section and having a bottom end which has a rounded or pointed shape and is inserted into the interior of the base frame.

The present invention also provides an electrical connector comprising a housing and one or more contacts as described above and arranged in the housing.

According to the present invention, each stopper projection is located in the plane within which the corresponding side wall is disposed, and thus stopper projections can be formed together with the side wall by a single stamping step. Thus the manufacturing is simplified. Further, the spring arm is kept in position in a preload state, and thus, when the contact portion is pushed down, the pushing force subjected by the contact portion is maintained above a certain level. In this way, reliable electrical connection can be established between the two electrical devices. In addition, the force receiving point of the contact portion lies in front of the vertical central line of the base frame. In this condition, when the contact portion is pushed down, no torque that tends lift up the front end of the bottom wall will be induced by the downward pushing force. As a result, the bottom wall will be firmly attached to the first electrical device and will not detach from the later.

Accordingly, the contact and the electrical connector of the present invention can be manufactured in a simple way and presents a high reliability.

BRIEF INTRODUCTION TO THE DRAWINGS

DETAILED DESCRIPTION OF THE PREFERRED EMBODIMENTS

Hereinafter a preferred embodiment of a contact of the present invention for establishing electrical connection is described with reference to the drawings.

Figure 1:
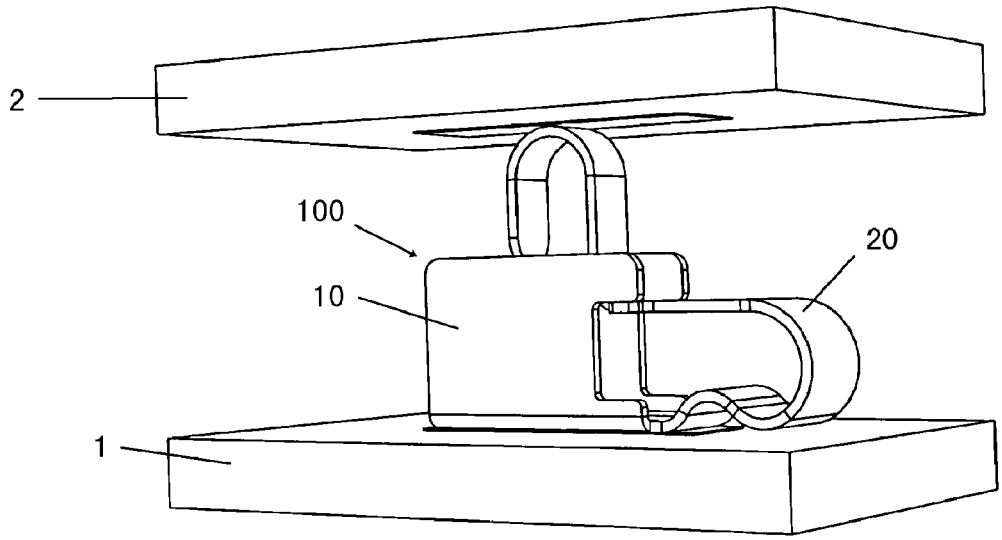
FIG. 1 is a perspective view of a contact in accordance with a preferred embodiment of the invention in a condition of forming electrical connection.
Figure 2:
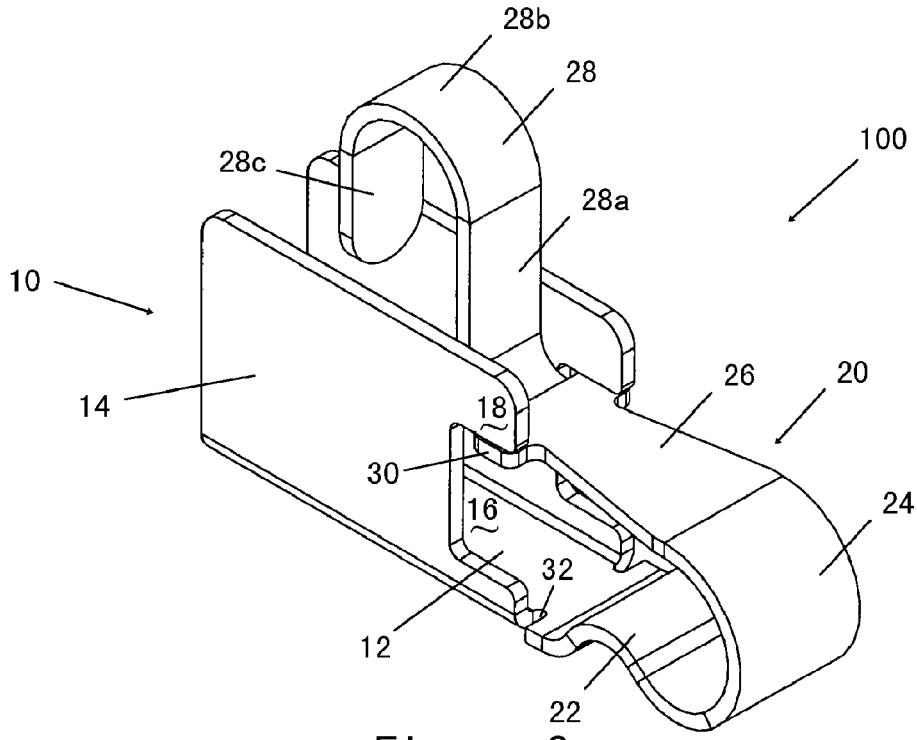
FIG. 2 is a perspective view of the contact of the present invention.
Figure 3:
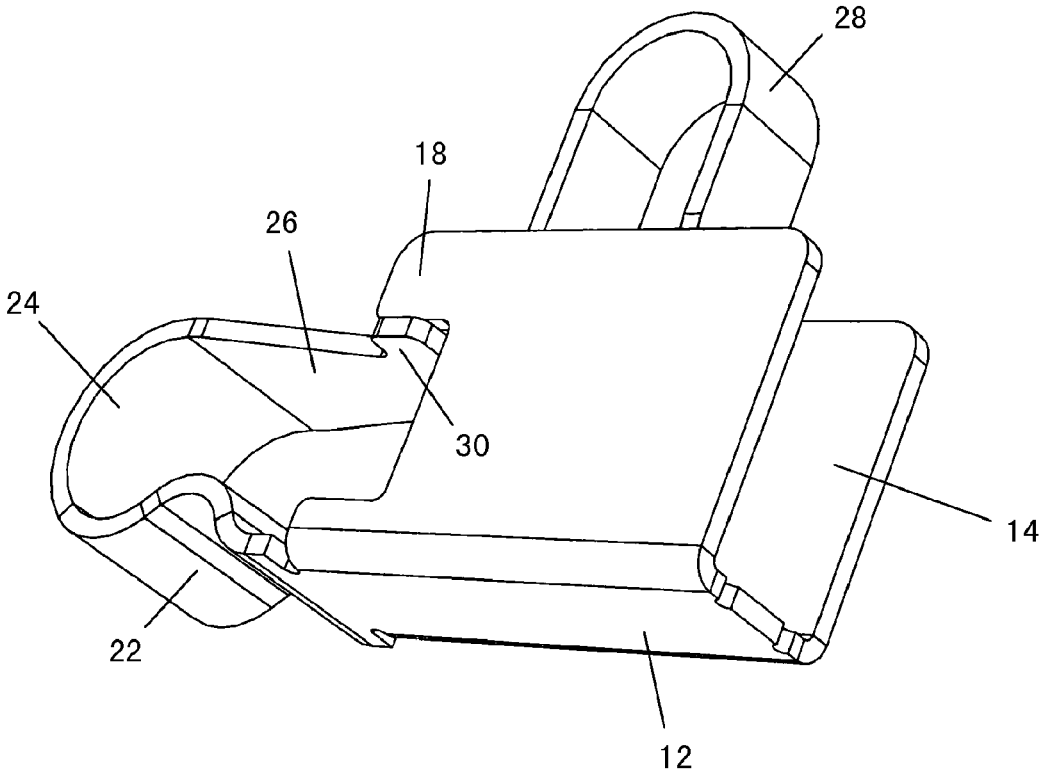
FIG. 3 is a perspective view of the contact of the present invention viewing from a different angle.
Figure 4:
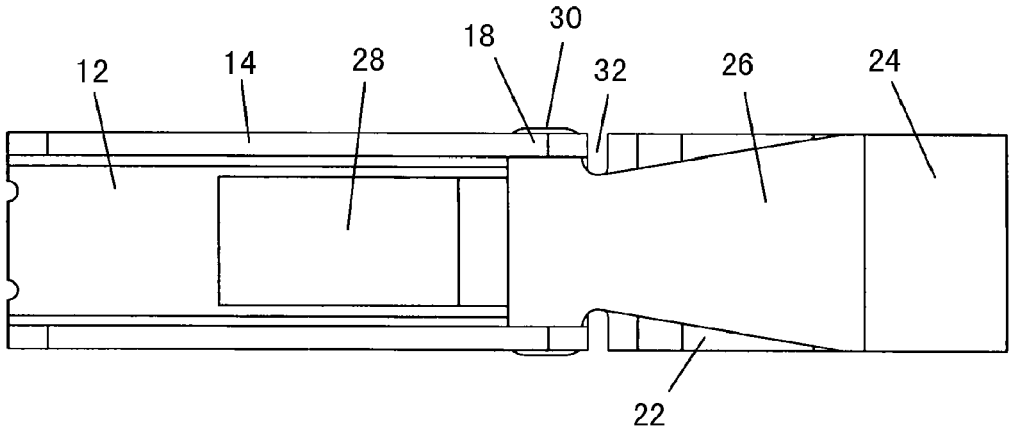
FIG. 4 is a plan view of the contact of the present invention.
Figure 5:
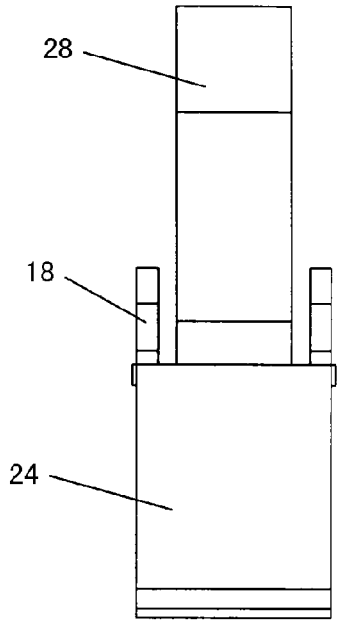
FIG. 5 is a right side view of the contact of the present invention.

As shown in FIG. 1, a contact 100 according to a preferred embodiment of the present invention is used for establishing electrical connection between a first electrical device 1 and a second electrical device 2. Contact 100 is a single piece item made of an elastic metal sheet. In use, contact 100 is fixed to the first electrical device 1, and can be elastically pressed down by the second electrical device 2 so as to reliably contact an electrical contact of the second electrical device 2, whereby electrical connection is established between the first and second electrical devices. The first and second electrical devices may each be a printed circuit board, an electrical connector, etc.

FIGS. 2-6 show further details of contact 100. In general, contact 100 includes a base frame 10 and a spring arm 20, which are integral with each other.

Base frame 10 comprises a flat bottom wall 12 having a generally rectangular shape and two side walls 14, in a generally rectangular shape for example, extending from opposite long sides of bottom wall 12 and perpendicular to bottom wall 12. Bottom wall 12 and side walls 14 define base frame 10 with a generally rectangular parallelepiped box shape. A spring arm 20 is integrally connected to a front end of bottom wall 12 and comprises a forward extending portion 22 extending from front end of bottom wall 12, a bent portion 24 extending upwardly from forward extending portion 22 and then bending backwardly, a backward extending portion 26 extending from bent portion 24 into the interior of base frame 10, and a contact portion 28 extending upwardly from backward extending portion 26.

Spring arm 20 in general has elasticity in a vertical direction. In the context, "vertical direction" is defined perpendicular to bottom wall 12 when bottom wall 12 lies in a horizontal direction. In this condition, a forward direction is defined as the direction along which forward extending portion 22 extends from bottom wall 12, while a backward direction is defined as the direction along which backward extending portion 26 extends from bent portion 24 towards base frame 10.

In this way, contact portion 28 is displaceable relative to base frame 10 upwardly and downwardly, and can be pressed down by second electrical device 2 against the upward elastic force of spring arm 20. With the elastic property of spring arm 20, a reliable electrical connection can be established between contact portion 28 and a corresponding contact element on the second electrical device 2.

Bottom wall 12 of base frame 10 is fixedly attached to first electrical device 1, by surface mount technology (SMT) or the like, and electrically connects with a wire or a contact element on the first electrical device 1. As an example, bottom wall 12 may be clamped to first electrical device 1 by a mechanical clamping structure, e.g. a rivet or screw. Alternatively, bottom wall 12 may be soldered to first electrical device 1.

To keep contact portion 28 at a limited predetermined height, or within a predetermined displacement range when contact portion 28 is not in contact with or pressed down by second electrical device 2, contact 100 is provided with a preload restrain structure. In the present embodiment, the preload restrain structure is formed by engaging features provided on base frame 10 and spring arm 20.

As shown in the figures, the engaging feature on base frame 10 comprises a stopper projection 18 formed on each side wall 14. Stopper projection 18 is formed by cutting away a part of the material of the front portion of side wall 14. The cut-away part forms a notch 16 in the side wall. In this way, stopper projection 18 is formed at an upper front portion of side wall 14, and lies in the plane of side wall 14. The manufacture process can be simplified, since both the stopper projections and the side walls can be formed by a single stamping step, without any further bending step.

The engaging feature on spring arm 20 comprises one or more projections 30 extending in a lateral direction from one or both of the opposite sides of a back end of backward extending portion 26. Backward extending portion 26 extends backwardly and being inserted into the interior of the base frame adjacent to a front end of base frame 10. In this way, projections 30 are located at positions facing stopper projections 18 respectively. Thus, projections 30 engage with stopper projection 18 by which, the displacement range of contact portion 28 is limited. Additionally, stopper projections 18 can apply downward pressure forces onto projections 30 to restrain projections 30 below stopper projections 18, by means of which spring arm 20 is constrained in a preload state.

Base frame 10 is a rectangular parallelepiped frame defined by bottom wall 12 and side walls 14. Thus, bottom wall 12 is strengthened by side walls 14 and has a high rigidity and is substantially not elastically deformable, although contact 100 is formed of an elastic sheet of metal. To create a good transition between the rigid bottom wall 12 and elastic spring arm 20, notches 32 are formed between a back end of forward extending portion 22 and the front end of bottom wall 12. In this way, spring arm 20 presents elasticity once extending away from bottom wall 12. In addition, the motion of the spring arm 20 and displacement of contact portion 28 has little influence on bottom wall 12.

Forward extending portion 22 has a generally forwardly extended wave-like shape which for example bends up first, then turns down, and then turns up again. Bent portion 24 has a generally arch shape which extends upwardly first and then turns and extends backwardly. By means of the combination of the shapes of forward extending portion 22 and bent portion 24, spring arm 20 possesses desired elasticity and mechanical strength.

Forward extending portion 22 and bent portion 24 each has a width that is substantially the same as that of base frame 10. Contact portion 28, when being pressed down, is partly located in the interior of base frame 10. For this reason, the contact portion 28 has a width which is smaller than the gap between side walls 14, and is thus also smaller than the width of forward extending portion 22 and that of bent portion 24. Backward extending portion 26, which is contiguous from bent portion 24 to contact portion 28, has a width that is wider at its front end and is narrower at its back end, or has a generally trapezoid shape.

Contact portion 28 comprises an upward extending section 28*a*, a contacting section 28*b* and a downward extending section 28*c* in this order. Upward extending section 28*a* extends upwardly from the back end of backward extending portion 26. Contacting section 28*b* has an upwardly convex arch shape, such as a semi-circular shape, a front end of which connects to an upper end of upward extending section 28*a*. Downward extending section 28*c* extends downwardly from a back end of contacting section 28*b*. Contacting section 28*b* is configured to be pressed down by an electrical contact on second electrical device 2. Downward extending section 28*c* has a bottom end having a rounded or acute angle shape and configured to be inserted into the interior of base frame 10, which facilitates the guided downward motion of the contact portion 28 by preventing contact portion 28 from being blocked by base frame 10. However, downward extending section 28*c* is not always necessary.

Figure 6:
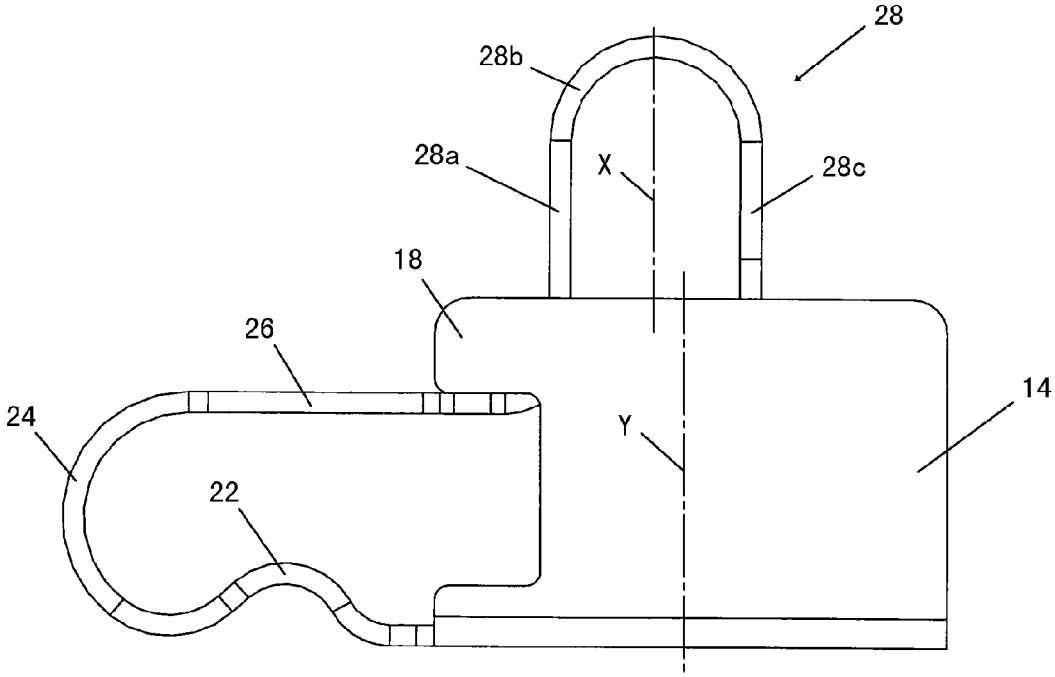
FIG. 6 is a front view of the contact of the present invention.

When projections 30 are constrained by stopper projections 18, spring arm 20 is in a preload state. In this condition, backward extending portion 26 lies substantially parallel to bottom wall 12. FIG. 6 shows this configuration with further details.

Since spring arm 20 is maintained in a preload state, when contact portion 28 is pressed down, the downward pressure force or pushing force applied onto contact portion 28 is greater than a predetermined level, which brings contact portion into contact with second electrical device 2. In this way, reliable electrical connection can be established between the first and second electrical devices 1 and 2.

It can also be seen from FIG. 6 that contact portion 28 may have a shape that is generally symmetrical with respect to a vertical central axis X, or at least contacting section 28*b* is generally symmetrical with respect to vertical central axis X. Vertical central axis X of contact portion 28 (or of the contacting section 28*b*), which may generally extend through the force receiving point of contact portion 28, is located in front of a vertical central axis Y of base frame 10 (or of the bottom wall 12). As a result, when contact portion 28 is pressed down, the downward pressure force applied along vertical central axis X will not create a torque on front end of bottom wall 12 tending to lift bottom wall 12. Thus, bottom wall 12 will be attached to first electrical device 1 firmly and will not be easily separated therefrom during use.

When manufacturing the contact, a flat blank having various parts of the contact is stamped out from an elastic sheet of metal. Various bent portions of spring arm 20 are formed in one or more subsequent bending steps. Then, the contact portion 28 or the backward extending portion 26 is pushed down so that projections 30 reach a position a little lower than the final position of the constrained projections when constrained by stopper projections 18. Thereafter, the parts for forming side walls 14 are bent upward from bottom wall 12 to a position perpendicular to bottom wall 2. In a next step, contact portion 28 or backward extending portion 26 is released, so that backward extending portion 26 moves upwardly under elastic force until projections 30 engage with stopper projections 18.

Alternatively, before pressing down contact portion 28 or backward extending portion 26, the parts forming side walls 14 may be bent upward from bottom wall 12 to a position perpendicular to bottom wall 2, and the upper edges of side walls 14 are elastically bent outwardly to an extend that projections 30 are allowed to move in. Thereafter, contact portion 28 or backward extending portion 26 is pressed down so that projections 30 reach a position a little lower than the final position of the constrained projections when constrained by stopper projections 18. After that, the upper edges of side walls 14 are released, and stopper projections 18 return back under elastic forces to engage projections 30.

In another aspect of the present invention, there provides an electrical connector which comprises one or more contacts 100 as described above and arranged in a housing of the electrical connector.

The present invention has been described above with reference to its preferred embodiments. However, the present invention is not to be limited in scope by the specific embodiments described herein. Indeed, various modifications of the invention in addition to those described herein will become apparent to those skilled in the art from the foregoing description and accompanying drawings. Such modifications are intended to fall within the scope of the claims.

The invention claimed is:

1. A contact for forming electrical connection between a first electrical device and a second electrical device, the contact comprising:

a base frame having a bottom wall and two side walls extending perpendicularly from opposite lateral edges of the bottom wall respectively, the bottom wall being configured to be fixed to the first electrical device; and a spring arm formed integrally with the base frame, the spring arm having a backward extending portion and a contact portion protruding upwardly from the backward extending portion and being configured to be pressed down by the second electrical device;

wherein a stopper projection is formed on each side wall, the stopper projection being located in a plane within which the side wall is disposed; and the backward extending portion is formed with projections extending outwardly from its opposite lateral edges, the projections engage with the stoppers to limit a displacement range of the contact portion, wherein each side wall is formed with a notch at a middle portion of a front edge of the side wall, the stopper projection being formed between the notch and an upper edge of the side wall.

2. The contact of claim 1, wherein the spring arm having a forward extending portion extending forwardly from a front end of the bottom wall, a bent portion extending upwardly from the forward extending portion and then bending backwardly, wherein the backward extending portion extends backwardly from the bent portion, wherein opposite cutouts are formed between a back end of the forward extending portion and the front end of the bottom wall.

3. The contact of claim 1, wherein the spring arm having a forward extending portion extending forwardly from a front end of the bottom wall, a bent portion extending upwardly from the forward extending portion and then bending backwardly, wherein the backward extending portion extends backwardly from the bent portion, wherein the forward extending portion has a wave-like shape, and the bent portion has an arch shape.

4. The contact of claim 1, wherein the spring arm having a forward extending portion extending forwardly from a front end of the bottom wall, a bent portion extending upwardly from the forward extending portion and then bending backwardly, wherein the backward extending portion extends backwardly from the bent portion, wherein the forward extending portion and the bent portion each have a width that is substantially equal to the width of the base frame, the contact portion has a width that is smaller than the width of the base frame, and the backward extending portion has a width that is narrowed from its front end to its back end.

5. The contact of claim 1, wherein a vertical central axis of the contact portion lies in front of a vertical central axis of the base frame in a longitudinal direction.

6. The contact of claim 1, wherein the spring arm having a forward extending portion extending forwardly from a front end of the bottom wall, a bent portion extending upwardly from the forward extending portion and then bending backwardly, wherein the backward extending portion extends backwardly from the bent portion.

7. The contact of claim 1, wherein the projections being pressed down and constrained in position by the stopper projections respectively.

8. An electrical connector comprising a housing and one or more contacts of claim 1 arranged in the housing.

9. The contact of claim 1, wherein the contact portion comprises an upward extending section and a contacting section, the upward extending section extending upwardly from the back end of the backward extending portion, and the contacting section having an upwardly convex arch shape and a front end connected with an upper end of the upward extending section.

10. The contact of claim 9, wherein the contact portion further comprises a downward extending section, the downward extending section extending downwardly from a back end of the contacting section and having a bottom end which has a rounded or acute angle shape and is inserted into the interior of the base frame.

11. A contact for forming electrical connection between a first electrical device and a second electrical device, the contact comprising:

a base frame having a bottom wall and two side walls extending perpendicularly from opposite lateral edges of the bottom wall respectively, the bottom wall being configured to be fixed to the first electrical device; and a spring arm formed integrally with the base frame, the spring arm having a backward extending portion and a contact portion protruding upwardly from the backward extending portion and being configured to be pressed down by the second electrical device;

wherein a stopper projection is formed on each side wall, the stopper projection being located in a plane within which the side wall is disposed; and the backward extending portion is formed with projections extending outwardly from its opposite lateral edges, the projections engage with the stoppers to limit a displacement range of the contact portion, wherein each side wall is formed with a notch at a middle portion of a front edge of the side wall, the projections of the backward extending portion being positioned in the notch and below the stopper projections.

* * * * *